US006682072B2

(12) United States Patent
Horikoshi et al.

(10) Patent No.: US 6,682,072 B2
(45) Date of Patent: Jan. 27, 2004

(54) GAME PIECE WITH ADJUSTABLE CENTER OF GRAVITY

(75) Inventors: Kenji Horikoshi, Tokyo (JP); Masayoshi Kubota, Tokyo (JP)

(73) Assignees: Takara Co., Ltd., Tokyo (JP); Wonder Farm Co., Ltd., Tokyo (JP)

( * ) Notice: Subject to any disclaimer, the term of this patent is extended or adjusted under 35 U.S.C. 154(b) by 60 days.

(21) Appl. No.: 10/093,256

(22) Filed: Mar. 7, 2002

(65) Prior Publication Data

US 2002/0153655 A1 Oct. 24, 2002

(30) Foreign Application Priority Data

Apr. 19, 2001 (JP) ..... 2001-002338 U

(51) Int. Cl.[7] ..... A63M 33/00
(52) U.S. Cl. ..... 273/126 R; 273/317; 473/588
(58) Field of Search ..... 273/126 R, 353, 273/317; 473/588

(56) References Cited

U.S. PATENT DOCUMENTS 2,923,548 A * 2/1960 Kappel ..... 273/386
4,940,441 A * 7/1990 Novinsky ..... 446/46
5,284,343 A * 2/1994 Bigornia et al. ..... 473/446
5,316,310 A * 5/1994 Nicholas et al. ..... 273/317
5,356,135 A * 10/1994 Montgomery ..... 473/434
5,671,925 A * 9/1997 Gonzalez ..... 473/588
5,697,858 A * 12/1997 Lekavich ..... 473/588
2002/0153655 A1 * 10/2002 Horikoshi et al. ..... 273/126 R

FOREIGN PATENT DOCUMENTS

JP 838664 2/1996
JP 838681 2/1996

* cited by examiner

*Primary Examiner*—Raleigh W. Chiu

(57) ABSTRACT

A game piece and game board assembly includes a game piece body having a weight mounting section. A weight member can be mounted at various locations on the weight mounting section to vary the center of gravity. The game piece can strike an opponent's game piece on a game board to score points. A cover can obscure the location of the weight member on the game piece.

13 Claims, 5 Drawing Sheets

GAME PIECE WITH ADJUSTABLE CENTER OF GRAVITY

BACKGROUND OF THE INVENTION

1. Field of the Invention

This invention relates to a toy game, and more particularly to a toy game improved so as to be suitably applied to the children of today as a challenging player participation throwing game with weighted game pieces.

2. Related Art

A toy game piece is one of typical traditional toys in Japan and commonly called a toy menko or merely a menko in Japan. A Japanese traditional toy menko or toy "dump" is made of a pasteboard. A menko or game using such toy menkos or toy games has been highly popular among children since early times. The menko game is generally practiced in such a manner that a game player strikes his own game piece against an opponent's game piece to overturn the latter, resulting in gaining it. Thus, the game exhibits increased gambling properties, to thereby be unsuitable as play for children. Also, a TV game has recently come into wide use among children. Such a circumstance causes the menko game to be rarely seen in the play world in spite of the fact that it exhibits increased play or game characteristics.

SUMMARY OF THE INVENTION

The present invention has been made in view of the foregoing disadvantage of the prior art.

Accordingly, it is an object of the present invention to provide a toy game which is improved so as to be suitably applied to children of today while exhibiting increased play or game characteristics as in a traditional toy game or menko.

In accordance with the present invention, a toy game is provided. The toy game includes a game piece body and at least one weight member detachably mounted on the game piece body. The game piece body is formed into a plate-like configuration. The game piece body is provided with at least one weight mounting section for detachably mounting the weight member therethrough on the game piece body while preventing the weight member from being detached from the game piece body.

In a preferred embodiment of the present invention, at least one of a card with indicia and a seal member for protecting the card may be arranged on un upper side of the game piece body. The card or seal can have a character or characteristics of the toy game piece described thereon.

In a preferred embodiment of the present invention, the toy game is played on a game board made of an elastic material.

In a preferred embodiment of the present invention, the toy game piece is generally formed into a square configuration.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate like or corresponding parts throughout; wherein.

DETAILED DESCRIPTION OF THE PREFERRED EMBODIMENT

Now, a toy game according to the present invention will be described with reference to the accompanying drawings.

Figure 1:
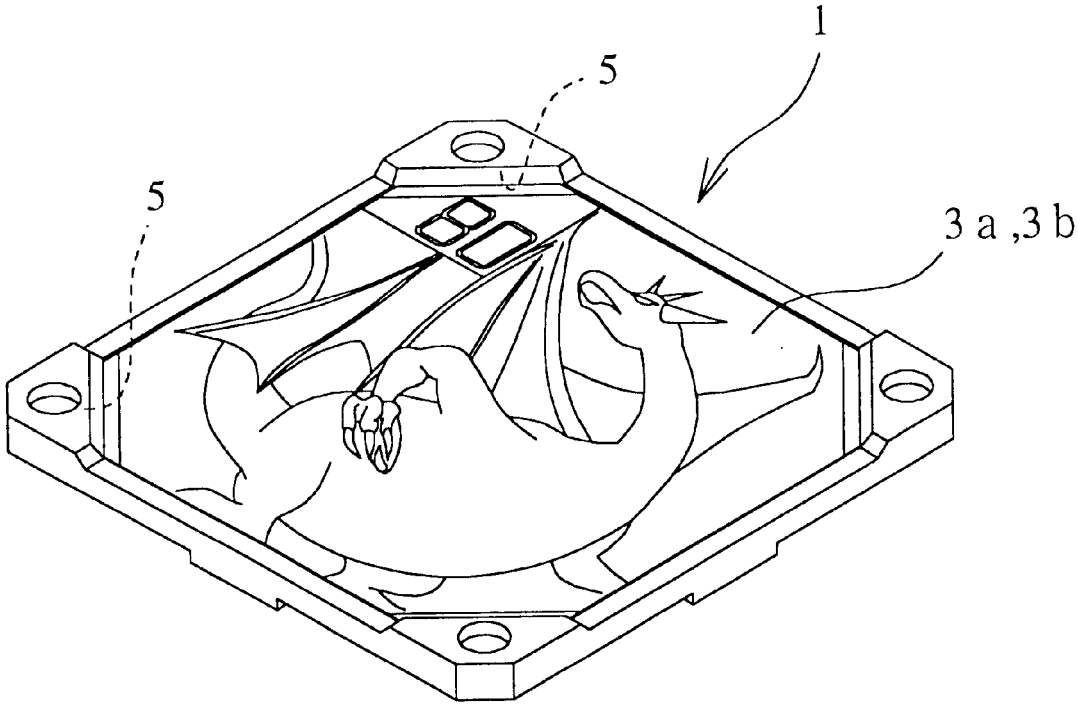
FIG. 1 is a perspective view showing an embodiment of a toy game according to the present invention.

Referring first to FIGS. 1 to 4, an embodiment of a toy or game piece according to the present invention is illustrated. A toy game piece of the illustrated embodiment generally designated at reference numeral 1 in FIG. 1 is generally constituted by a game piece body 1*a*, at least one weight member 2, front cover members 3*a* and 3*b* which may have indicia, and a rear cover member 3*c*.

Figure 2:
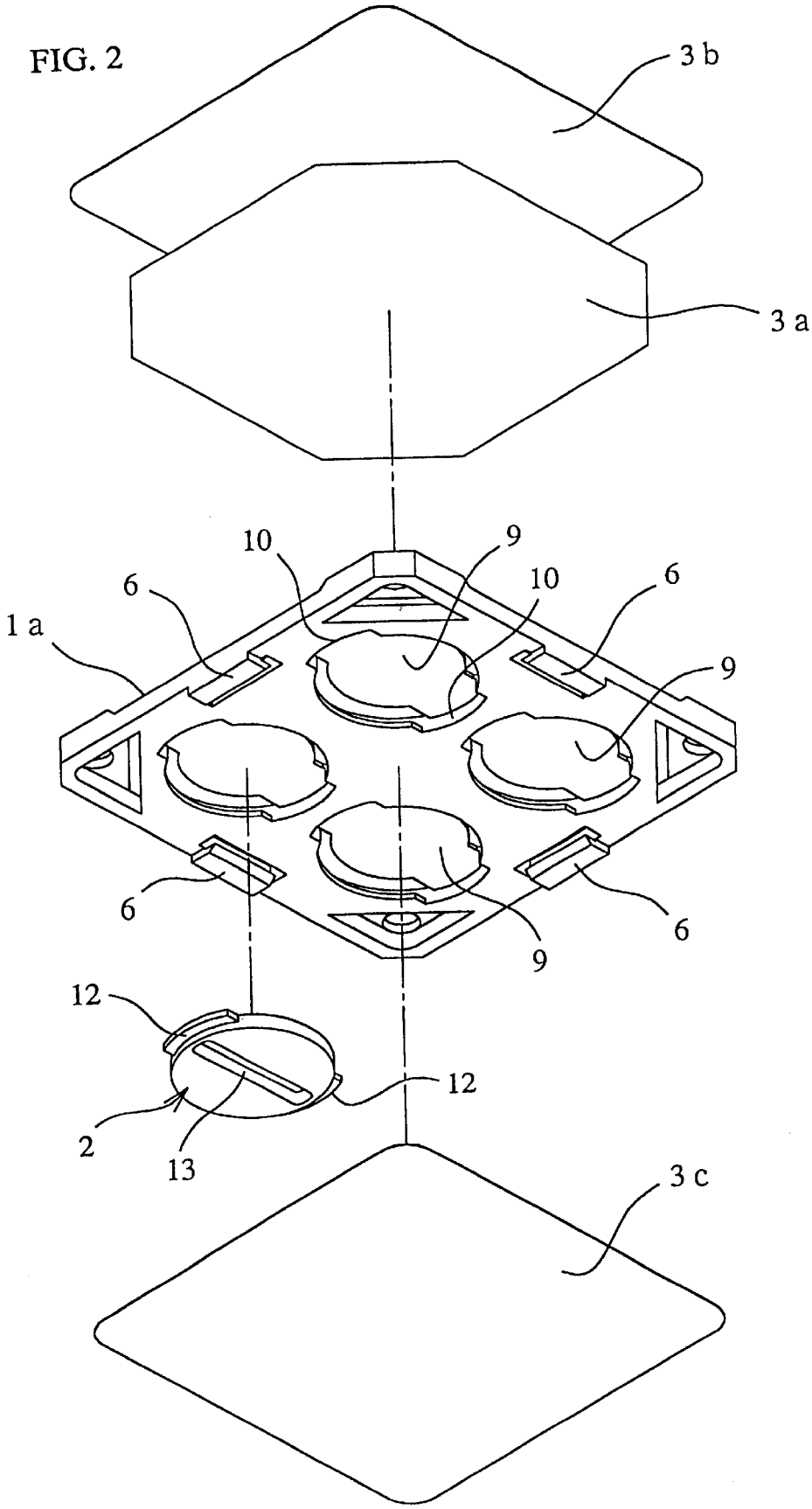
FIG. 2 is an exploded perspective view of the toy game shown in FIG. 1.
Figure 3:
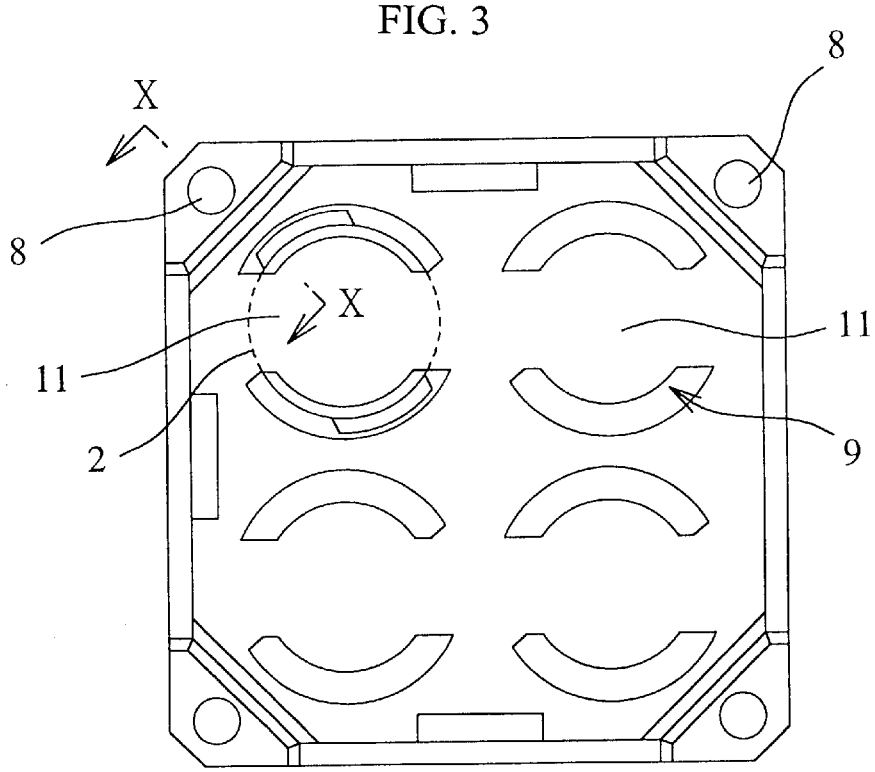
FIG. 3 is a plan view showing a game piece body of the toy game shown in FIG. 1.
Figure 4:
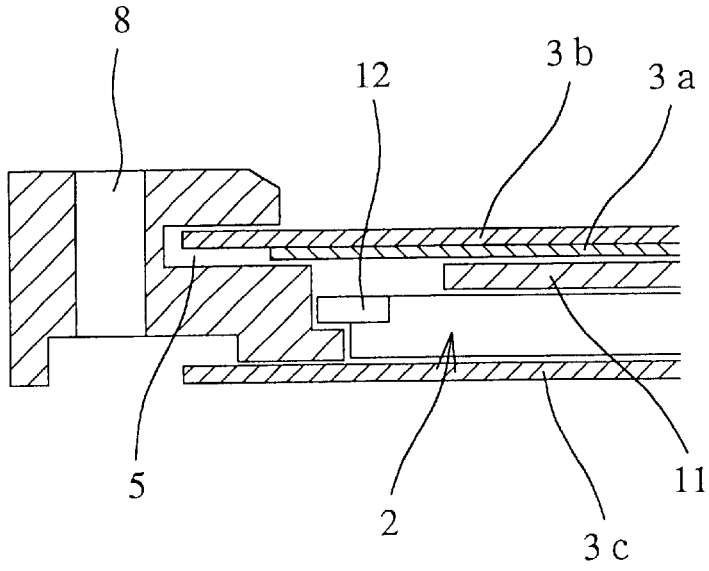
FIG. 4 is a fragmentary sectional view taken along line X—X of FIG. 3.
Figure 5:
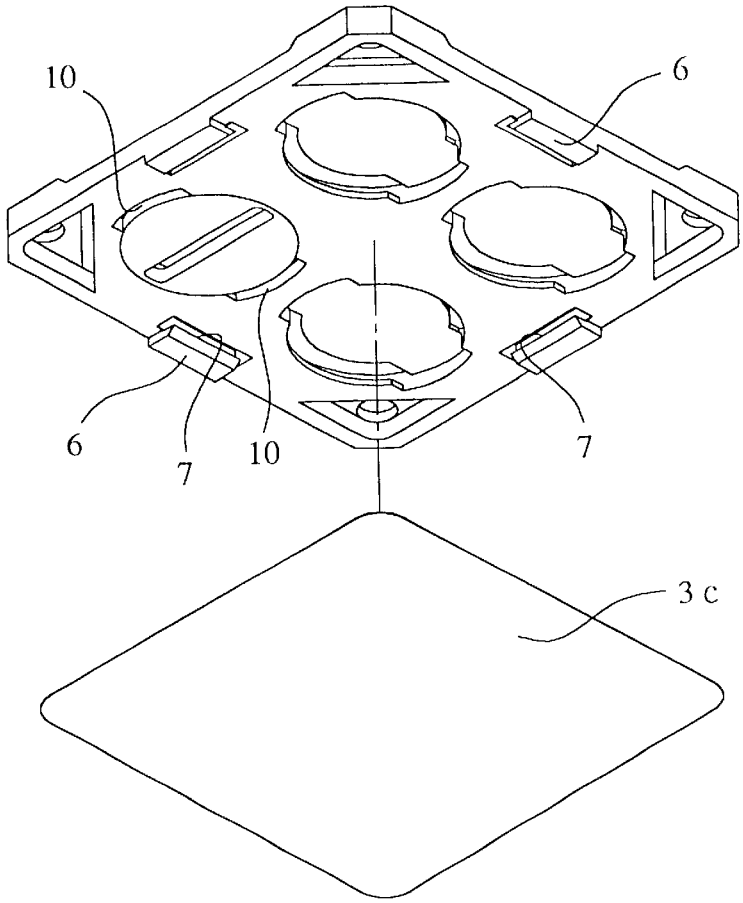
FIG. 5 is a perspective view showing mounting of a cover member on a rear side of the game piece body shown in FIG. 3.
Figure 6:
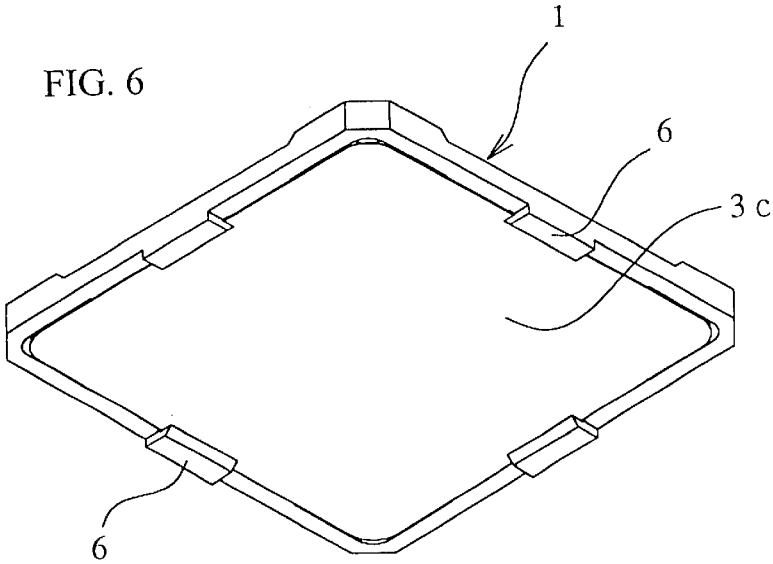
FIG. 6 is a perspective view showing a cover member which has been mounted on a rear side of the game piece body shown in FIG. 3.

The game piece body la is made of a synthetic resin material and formed into a plate-like square shape of which each side has a length of about 70 mm. The game piece body 1*a*, as shown in FIGS. 2 to 4, is formed at each of four corners thereof with a holding groove 5 for holding the cover members 3*a* and 3*b* therein. The holding grooves 5 each are formed so as to be open along a face of the game piece body 1*a*. The game piece body 1*a* is also formed at a central portion of each of sides of a rear surface or side thereof with a holding pawl 6 for the rear cover member 3*c*, so that a groove 7 may be defined between each of the holding pawls 6 and the rear surface or side of the game piece body 1*a*, as shown in FIG. 5. Further, the game piece body 1*a* is formed at each of the four corners thereof with a through-hole 8 so as to extend in an axial direction thereof or so as to extend through the front and rear surfaces thereof.

In addition, the game piece body 1*a* is provided with four weight mounting sections 9, each of which is arranged so as to permit the weight member 2 to be selectively mounted therein in a detachable manner. More specifically, the weight mounting sections 9 each provided on a rear side thereof with a pair of overhangs 10 in a manner to be opposite to each other. Also, the weight mounting sections 9 each are formed on a front side thereof with a circular opening, which is formed into a size covering the overhang 10. The openings each are closed with each of bridges 11 formed on the front side of the game piece body 1*a*.

The weight member 2 may be made of a suitable material such as synthetic resin, wood, metal or the like and formed into substantially the same configuration as that of the rear side of each of the weight mounting sections 9. Also, the weight member 2 is formed into a size sufficient to permit it to be fitted in the weight mounting section 9 arranged on the rear side thereof. Further, the weight member 2 is provided on both sides thereof with a pair of lugs 12 in correspondence to the overhangs 10 of each of the weight mounting sections 9. In addition, the weight member 2 is formed at a central portion thereof with a slit groove 13 so as to extend therethrough.

One of the front cover members which is designated at reference numeral 3*a* is made of a paper material having a suitable pattern such as a character or the like applied thereto, resulting in being a label cover member. The other front cover member 3*b* is made of a transparent plastic material, resulting in being a plastic cover member. Also, the rear cover member 3*c* is made of a transparent plastic material. The cover members 3*a*, 3*b* and 3*c* each are formed into a substantially square shape.

The front cover members 3*a* and 3*b* may be replaced with a single cover member made of a plastic material and having any desired pattern printed thereon. The single cover member may be made in the form of either a card-like member or a seal-like member.

Now, a manner of assembling the toy game piece of the illustrated embodiment thus constructed will be described.

First of all, the weight member 2 is fitted in any desired one of the weight mounting sections 9 provided on the rear side of the game piece body 1*a* as shown in FIG. 2. Then, the weight member 2 is rotated by means of a coin or the like fitted in the slit groove 13 of the weight member 2 as shown in FIG. 5, so that the lugs 12 of the weight member 2 each may be moved to a position under each of the overhangs 10, to thereby be held therein. This results in preventing the weight member 2 from being detached from the lower side of the game piece body 1*a*. Also, the game piece body 1*a*, as described above, is formed on the front side thereof with the bridges 11, each of which prevents the weight member 2 from being detached from the front side of the game piece body 1*a*. This permits the weight member 2 to be firmly held in the weight mounting section 9. Then, the rear cover member 3*c* is applied to the rear side of the game piece body 1*a*, so that the central portion of each of the sides thereof is held by each of the holding pawls 6. Subsequently, the label cover member 3*b* and plastic cover member 3*a* are superposedly arranged on the front side of the game piece body 1*a* in order and then each of the corners of the cover members 3*a* and 3*b* is held in each of the holding grooves 5 of the game piece body 1*a* as shown in FIGS. 1 and 4. This results in assembling of the toy game piece 1 being completed.

For preparation of a game carried out using the toy game piece of the illustrated embodiment, the weight member 2 is selectively mounted in any desired one of the weight mounting sections 9 to adjust weight balance of the toy game piece 1 as desired. The rear cover member 3 is made of a transparent material as described above, so that the weight mounting section 9 in which the weight member 2 is mounted may be visibly observed from the rear side of the toy game 1.

Disassembling of the toy game piece 1 thus assembled is carried out by detaching the front and rear cover members 3*a*, 3*b* and 3*c* from the game piece body 1*a* and then rotating the weight member 2 in a direction opposite to that described above to release it from the game piece body 1*a*.

Figure 7:
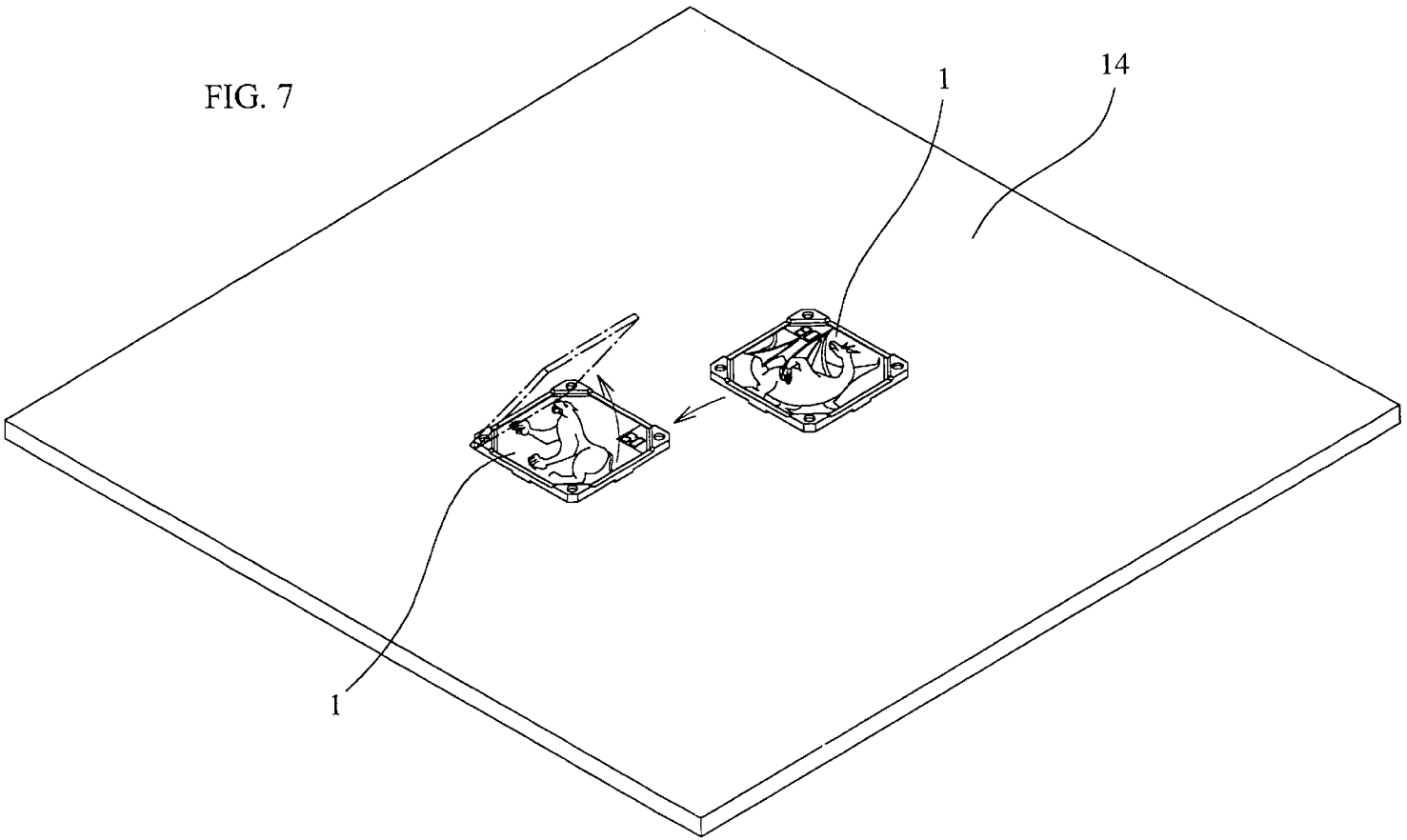
FIG. 7 is a perspective view showing a toy game piece and a game board.

The toy game piece 1 of the illustrated embodiment constructed as described above may be preferably or conveniently played on a dedicated game board 14 constructed as shown in FIG. 7. The game board 14 is preferably made of an elastic material and formed into a square configuration which has sides each formed into a length about 12 times as long as that of each of the sides of the toy game piece 1. Elasticity of the game board 14 prevents the toy game piece 1 from being damaged when the latter is struck against the former. Also, such elasticity, when a game player strikes his toy game piece 1 against the game board 14, permits the toy game piece 1 to relatively readily overturn the toy game piece of an opponent player on the game board 14 or flick it out thereof.

For the purpose of enjoying a menko game using the toy game piece of the illustrated embodiment, it is desired to predetermine a rule for the game. More specifically, a win-loss record of the game is determined by a score. When a player carries out a striking operation or strikes his toy game piece against the toy game piece of an opponent player, to thereby overturn the opponent's toy game piece, he scores one point. The game may be carried out, for example, in a one-to-one or two-to-two relation. An order in which striking operation is carried out is determined by a kind of mora or tossing of a coin. Then, each of the game players selects any one of the four sides of the square game board 14 as his own position. In a one-to-one game (or a two-player game), two of the four sides of the game board 14 adjacent to each other are selected as positions for each of the two players. In this case, the two players each hold eight such toy game pieces 1. In a two-to-two game (or a four-player game), one of the four sides is selected as a position for reach of the four players. Each of the four players holds four such toy game pieces 1. During the game, each of the game players can carry out a striking operation only within his own position. Later striking players or players who carry out a striking operation later may each place any desired one of their own toy game pieces on the game board 14. A first striking player or a player who first carries out a striking operation strikes any desired one of his own toy game pieces against any one of the toy game pieces of later striking players (or opponent players) placed on the game board 14, as in the traditional toy menko. When such a striking operation by the first striking player causes overturning of the toy game piece 1 of any one of the remaining players or opponent players, the first striking player scores one point. Then, the game is advanced while keeping the overturned toy game piece left on the game board 4. During advance of the game, when any one of later striking players strikes his toy game piece against the overturned toy game piece to overturn it again or permit it to face up, the score of the first striking player is invalidated or canceled. Also when a player strikes his toy game piece against the toy game piece of any opponent player to flick the latter out of the game board 14, he is permitted to make a score. However, in this case, when the player causes his own toy game piece to be put out of the game board 14, the opponent players each make a score. When any player concurrently overturns two or more toy game pieces of opponent players at a time, he scores predetermined points, as well as bonus points. When all players subject their own toy game pieces to the a striking operation or play, their scores are totalized and compared with each other, resulting in a player which has scored the highest score winning the game.

The game carried out in such a manner as described above permits gambling properties as seen in the traditional toy game to be substantially eliminated from the toy game. Also, it permits the toy game to exhibit significantly enhanced game properties. Thus, the toy game of the illustrated embodiment provides a wholesome play or game.

Also, in the illustrated embodiment, mounting of the weight member 2 on the rear side or rear surface of the game piece body 1*a* leads to a variation in characteristics of the toy game 1. For example, the toy game piece may be operated in such a manner that the weight mounting side of the toy game piece attacks the toy game piece of any opponent player. This leads to significant damage to the opponent's toy game piece and renders overturning of his own toy game piece difficult. Further, the label cover member which is one of the front cover members has a pattern or the like applied thereto, to thereby render a position in the game piece body at which the weight member is arranged invisible from the front side of the toy game piece. Thus, it is demanded that a player makes a game while supposing a position of a center of gravity of the toy game. This requires a skill and force, as well as good luck in order to overturn the toy game piece of any opponent player, resulting in the game being more complicated or sophisticated.

Further, in the illustrated embodiment, the label cover member may have characteristics of the toy game piece 1 such as the number of weight members or the like displayed thereon. This permits a consumer to enjoy collection of only the label cover members or cards.

The toy game piece of the illustrated embodiment may be generally formed into a circular configuration as a whole. In this instance as well, the toy game piece may be constructed in substantially the same manner as described above.

Moreover, it is not necessary required that the rear cover member is transparent.

As can be seen from the foregoing, the toy game piece of the present invention is so constructed that the game piece body is formed into a plate-like configuration and provided with at least one weight mounting section for detachably mounting the weight member therethrough on the game piece body while preventing the weight member from being detached from the game piece body. Such construction permits a center of gravity of the toy game piece to be suitably set as desired. Also, it permits an opponent player to be hard to visually recognize a position of the weight member in the toy game piece, so that the opponent player is required to play a game while presuming a position of a center of gravity of the toy game piece. Thus, in order to win a game, a player requires a skill and force, as well as good luck, resulting in the game being more complicated or sophisticated. Also, establishment of a rule for the game permits game characteristics of the toy game piece to be enhanced while eliminating gambling properties therefrom.

Also, the toy game piece of the present invention may permit the card and/or seal to be arranged on the upper side of the game piece body, wherein the card and/or seal may have a character or characteristics of the toy game piece described thereon. This permits the game to be complicated or sophisticated and a player to enjoy collection of the card and/or seal as well as the game.

Further, in the present invention, the toy game may be played on the game board made of an elastic material. This minimizes damage to the toy game piece and enhances game characteristics of the toy game.

Moreover, in the present invention, the toy game piece may be generally formed into a square configuration. Such configuration of the toy game piece leads to enhancement in game characteristics of the toy game, because a player strikes a corner of his toy game piece or a side thereof against the toy game piece of an opponent player.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A toy game assembly for scoring game points by throwing a game piece to strike an opponent's game piece, comprising:

a plurality of game pieces, each game piece having a body member with a larger length than thickness and of a size to be held in a player's hand for throwing;

at least one surface of the body member has indicia;

the body member has a plurality of weight mounting sections with retention capability; and a plurality of weight members of a size to be retained within the weight mounting sections, whereby a player can selectively mount a weight member within a weight mounting section to alter a center of gravity of a game piece, wherein the weight mounting sections include an overhanging peripheral flange and the weight members have a complementary lug to lockingly interface with toe overhanging peripheral flange.

2. The toy game assembly of claim 1, wherein four spaced weight mounting sections are provided.

3. The toy game assembly of claim 1, wherein the body member includes an approximately square plastic body.

4. The toy game assembly of claim 3 further including a first cover member, wherein the body member includes holding members for removably retaining the first cover member, the first cover member extends across the weight mounting sections.

5. The toy game assembly of claim 4 further includes a second cover member for removably being retained by the holding members wherein the second cover member also extends over an opposite side of the weight mounting sections.

6. The toy game assembly of claim 4 wherein the weight member includes a groove to assist rotation of the lug for locking the weight member in a weight mounting section by rotation.

7. A game piece that can be thrown to strike other game pieces for scoring game points comprising:

a body member with a larger length than thickness and a size to be held in a player's hand for throwing; the body member has a plurality of weight mounting sections with retention capability;

a plurality of weight members of a size to be retained within the weight mounting sections, whereby a player can selectively mount a weight member within a weight mounting section to alter a center of gravity of the game piece; and a first cover member, the body member includes holding members for removably retaining the first cover member, the first cover member extends across the weight mounting sections to obscure them from view.

8. The toy game assembly of claim 7 further includes a second cover member for removably being retained by the holding members wherein the second cover member also extends over an opposite side of the weight mounting sections whereby the weight mounting sections are positioned within the body member and between the front and second cover members.

9. The toy game assembly of claim 8 wherein the weight mounting sections include an overhanging peripheral flange and the weight members have a complimentary lug to lockingly interface with the overhanging peripheral flange.

10. The toy game assembly of claim 9 wherein four space weight mounting sections are provided.

11. The toy game assembly of claim 10 wherein the weight member includes a groove to assist rotation of the lug for locking the weight member in a weight mounting section by rotation.

12. The toy game assembly of claim 11 wherein the body member includes an approximately square plastic body.

13. A game piece and game board assembly comprising;

a game piece body having a weight mounting section;

a weight member removably mounted on the weight mounting section; the game piece body is generally formed into a square configuration with a cover member removably mounted on the game piece body, and the cover member having indicia thereon; and a game board member made of an elastic material, wherein the game piece is played on the game board.

* * * * *